US007243772B2

(12) United States Patent
Harris et al.

(10) Patent No.: US 7,243,772 B2
(45) Date of Patent: Jul. 17, 2007

(54) COIN-VALIDATION ARRANGEMENT

(75) Inventors: Jeffrey A Harris, Rhonda Cynnon Taff (GB); James Churchman, Llysworney (GB); Darren Sharman, Baldock (GB)

(73) Assignee: Marconi UK Intellectual Property Ltd., Coventry (GB)

( * ) Notice: Subject to any disclaimer, the term of this patent is extended or adjusted under 35 U.S.C. 154(b) by 695 days.

(21) Appl. No.: 10/203,394

(22) PCT Filed: Feb. 1, 2001 (Under 37 CFR 1.47)

(86) PCT No.: PCT/GB01/00430

§ 371 (c)(1), (2), (4) Date: Feb. 28, 2003

(87) PCT Pub. No.: WO01/59714

PCT Pub. Date: Aug. 16, 2001

(65) Prior Publication Data

US 2004/0084278 A1 May 6, 2004

(30) Foreign Application Priority Data

Feb. 9, 2000 (GB) ..... 0002883.7

(51) Int. Cl.
*G07D 5/00* (2006.01)
*G07D 5/08* (2006.01)

(52) U.S. Cl. ..... 194/302

(58) Field of Classification Search ..... 194/302, 194/303, 304, 306, 317, 318, 319, 320, 321, 194/325; 73/163
See application file for complete search history.

(56) References Cited

U.S. PATENT DOCUMENTS 4,234,071 A 11/1980 Le-Hong
5,220,614 A 6/1993 Crain
5,452,785 A * 9/1995 Iwamoto et al. ..... 194/318

FOREIGN PATENT DOCUMENTS

EP 0 060 392 A2 9/1982
EP 0 318 229 A2 5/1989

* cited by examiner

*Primary Examiner*—Patrick Mackey
*Assistant Examiner*—Mark J. Beauchaine
(74) *Attorney, Agent, or Firm*—Kirschstein, et al.

(57) ABSTRACT

A coin-validation arrangement in which a wavelet analysis is used to derive accurate information from signals related to coin sensors placed in the path of an input coin, this information being compared with corresponding information relating to sample coins, the result of the comparison giving rise to a "pass/fail" validation decision on the input coin. The information may be derived from a sampling of the sensor-related signal, a measurement of signal amplitudes for each point and a correlation of each amplitude with the corresponding amplitude of one or more preselected wavelets to provide a set of correlation coefficients. In an alternative embodiment the sampled sensor-related signal is subjected to a discrete wavelet transform operation using high-and low-pass filtering and subsequent subsampling stages, thereby producing a set of DWT coefficients. In either case the number of coefficients used in the comparison process may be reduced, thereby saving processing power.

27 Claims, 4 Drawing Sheets

COIN-VALIDATION ARRANGEMENT

The invention relates to a coin-validation arrangement and in particular, but not exclusively, a coin-validation arrangement able to discriminate between a number of coins in a set of coins and between valid and non-valid coins.

Various techniques exist for validating coins inserted into coin mechanisms. One such employs an inductive coil which is large compared with the size of the largest coin to be validated and lies along the path of the coin through the mechanism. This is illustrated in FIG. 1(*a*), in which item 10 is the inductor, item 12 is the floor of the coin chute or runway and items 14 and 16 are large and small coins, respectively. As each coin passes the inductor 10, it perturbs the magnetic field of the inductor and, if it is assumed that the inductor is included in the resonant tank circuit of an oscillator, the frequency of the oscillator is thereby changed. This gives rise to the waveforms shown in FIG. 1(*b*), which waveforms represent a plot of frequency deviation from a reference value against time. Since coin 14 is larger than coin 2, the resultant frequency change is larger. In addition, the time over which the frequency is changed is longer for the larger coin than for the smaller coin.

Usually the validator must be able to identify and accept coins from a set of desirable coins and also identify and reject objects that are in a further set of known undesirable objects. This second set might be foreign coins of similar characteristics to the desirable coins, or known substitutes such as washers or slot-machine tokens. Objects that do not fall into either set are also rejected. In order to obtain the required discrimination, a number of accurate measurements may be taken, e.g. the amplitudes of the peaks of each waveform corresponding to each object in each set and the width of each peak or the starting or finishing point of each peak.

An alternative approach, where accuracy and discrimination of a large number of coins is of less importance, is to use simpler inductive or capacitive detectors operating in the same circuit, but physically separated along the coin path. Again, a change in signal is generated as the coin passes each detector. Two measurements are taken, which are conventionally the magnitude of the two peaks (these again being peak values of frequency deviation). FIG. 2 shows this scheme, in which two capacitor plates 20, 22 are employed spaced apart along the floor 12. The resultant signal from the two detectors shows a first peak 24 when coin 14 passes detector 22 and a second peak 26 when the same coin passes detector 20. Similarly there is a first peak, largely equal in amplitude to the already-mentioned first peak, when coin 16 passes detector 22 and a second peak 28, smaller in amplitude than the already-mentioned second peak when the same coin passes detector 20. The peak 28 is smaller than the peak 26 in view of the smaller influence exerted by coin 16 on the capacitance formed from the plate 20.

In practice, plate 22 is normally positioned near the top of the floor 12 a suitable distance from the plate 20, so as to provide maximum discrimination between the two coins.

A third technique employs, instead of a large inductor, several small inductors arranged along the coin path. This is depicted in FIG. 3, in which coins 14 and 16 follow a path towards inductors 30, 32 and 34. These inductors are significantly smaller in size than the smallest coin (e.g coin 16) to be discriminated and are spaced apart both in the direction of coin movement and normal to that direction. The waveforms associated with the three inductors are shown in FIG. 3(*b*) and once again relate to frequency deviation. As the small coin, coin 16, passes inductor 34, little change is made to its magnetic field, whereas when it passes inductors 32 and 30 a significantly larger change is made. The larger coin 14, on the other hand, gives essentially the same peak amplitude value in the signals from the three inductors, but the width of the peaks is largest for inductor 32 in view of its position approximately halfway up the coin 14. These signals vary according to the material and thickness of the various coins. These small inductors are suitable for detecting the more modern bimetallic coins having a disc of one metal surrounded by a ring of a contrasting metal. In this case the waveforms associated with the different inductors show dips or rises for the outer ring and centre portions individually.

The discriminating power of a validator is limited by the number of measurements that can be taken and their accuracy. Where, as is typical, only the peak magnitude of the various detector signals is measured, when two detectors are employed coins can be described by a rectangular area within a two-dimensional measurement space, this space being the area of acceptability of the respective coins. This is shown in FIG. 4 in respect of the two-capacitor arrangement of FIG. 2. In FIG. 4, the detector outputs for coin 16 (the smaller coin) are nominally equal for the two detectors, but since different specimens of the same coin will have slightly different properties, including (to a small extent) diameter and thickness, there will be a spread in the acceptability peak values, giving rise to the rectangular window 40. Similarly, there is a rectangular window 42 for coin 14 corresponding to the same peak value in the case of detector 22 and a higher peak value in the case of detector 20.

If two coins share similar characteristics, they may be difficult to distinguish in these windows, leading to mistakes in recognising the coins or, in extreme cases, inability to discriminate the coins at all. This problem can be eased by adding further detectors or by changing the position or characteristics of the detectors, but this then means that the validator is physically suited to only a limited set of coins and may not be able to be reprogrammed to accept new coins added to a set (compare the introduction of the euro in Europe).

Improvement in discrimination is possible by performing a cross-correlation of the coin signal with the reference values stored in the validator (EP-A-0 060 392) instead of simply comparing peak detector outputs as with the windows 40, 42 referred to above, but such a computation would be time-consuming in terms of the time allowed for assessment by the nature of a validator, if the computation were to be performed digitally.

In accordance with the present invention there is provided a coin validation arrangement comprising a coin-guide means for guiding an input coin along a predetermined coin path, one or more coin sensors disposed in the path of the input coin, a circuit means for sensing the effect of the input coin on the parameter of the one or more sensors and providing an input-coin signal representative of said effect, and means for sampling the input-coin signal to produce a sequence of sample values, characterised in that the arrangement comprises means for multiplying respective values of a plurality of detection waveforms characteristic of a particular coin, each detection waveform comprising a sequence of numerical values, by those of the input-coin signal, and for summing the products to produce an evaluation value corresponding to each detection waveform, and means for determining whether each of the evaluation values falls within predetermined limits, in order to validate the coin.

The one or more detection waveforms may each satisfy the condition $$\int_{-\infty}^{\infty} f^2(t)dt \text{ is finite}$$

where $f(t)$ is a function defining a particular waveform. More stringently, they may satisfy the condition $$\int_{-\infty}^{\infty} f(t)dt = 0$$

where $f(t)$ is a function defining a particular waveform.

The one or more detection waveforms may comprise a single first detection-waveform defined by a first sequence of numerical values and a plurality of detection waveforms defined by respective sequences of numerical values, the respective sequences being shorter than the first sequence.

The plurality of detection waveforms may comprise two second detection-waveforms having respective second sequences shorter than the first sequence and four third detection-waveforms having respective third sequences shorter than the second sequences. The second sequences may be equal to each other and the third sequences may be equal to each other. Furthermore, the second sequences may be one-half the length of the first sequence and the third sequences one-half the length of the second sequences.

The second sequences may follow directly on from each other and the third sequences may follow directly on from each other. One or more of the sequences may be extended such that it contains a number of values equal to the number of samples in the sampled input-coin signal, those values lying outside the core of values which defines the particular detection waveform having a value of zero.

The one or more detection waveforms are preferably chosen such as to provide a strong correlation with the sampled input-coin signal.

An amplitude of the signal may be sampled at a plurality of points in time to form a signal vector, the signal vector being correlated with one or more detection vectors associated with respective said one or more detection waveforms thereby to provide respective correlation vectors, one or more of which are used to provide said validation indication. Coefficients of the one or more correlation vectors may be compared with corresponding coefficients of respective reference vectors associated with a sample input coin or set of coins, a result of this comparison being used to provide said validation indication. The respective reference vectors may be associated with a plurality of sample input coins or set of coins, thereby to determine an acceptable spread of allowable comparison values.

Coefficients of each of the one or more correlation vectors may be processed to provide one or more evaluation coefficients, said one or more evaluation coefficients being used to provide said validation indication. The one or more evaluation coefficients may be compared with corresponding coefficients associated with a sample input coin or set of coins, a result of this comparison being used to provide said validation indication.

The corresponding coefficients may be associated with a plurality of sample input coins or set of coins, thereby to determine an acceptable spread of allowable comparison values. The correlation coefficients may be processed, e.g. summed together, to provide a single evaluation value.

The validation indication may be provided on the basis of a function involving said evaluation coefficients and said sample-coin coefficients. The function may be expressed as:

$$f=w_1(Ai_1-As_1)^2+w_2(Ai_2-As_2)^2+\ldots+w_n(Ai_n-As_n)^2$$

where $Ai_{1-n}$ are n evaluation coefficients of the input coin, $As_{1-n}$ are n sample-coin coefficients and $w_{1-n}$ are n weighting factors associated with the respective evaluation and sample-coin coefficients.

The coin sensors may be all or partly inductive or all or partly capacitive, the parameter being inductance or capacitance accordingly.

In accordance with a second embodiment of the invention there is provided a method for validating a coin inserted into a coin mechanism having a coin-guide means for guiding an input coin along a predetermined coin path and one or more coin sensors disposed in the path of the input coin, the method comprising sensing the effect of the input coin on the parameter of the one or more sensors and providing an input-coin signal representative of said effect, and sampling the input-coin signal to produce a sequence of sample values, characterised by the step of multiplying respective values of a plurality of detection waveforms characteristic of a particular coin, each detection waveform comprising a sequence of numerical values, by those of the input-coin signal, and of summing the products to produce an evaluation value corresponding to each detection waveform, and determining whether each of the evaluation values falls within predetermined limits, in order to validate the coin.

The detection waveforms may be wavelets.

The input-coin signal may be subjected to a discrete wavelet transform (DWT) process which yields a set of transform coefficients, said transform coefficients may be compared with a corresponding set of coefficients relating to a sample coin or set of coins, and said decision may be made on the basis of this comparison. More specifically, preferably the input-coin signal is sampled, the sampled signal is subjected to low-pass and high-pass filtering and subsequent subsampling by a factor of 2, and the subsampled results of the highpass filtering form part of the set of transform coefficients, the low-pass subsampled values being subjected to similar low-pass and high-pass filtering and subsequent subsampling, the results of that subsampled high-pass filtering likewise forming a part of the transform coefficient set, and so on for a given number of filtering and subsampling operations.

The final filtering and subsampling operation preferably occurs when the subsampled high-pass filtering for that stage yields only one coefficient. The filtering and subsampling operations are advantageously performed in software.

Embodiments of the invention will now be described, by way of example only, with reference to the drawings, of which:

FIGS. 1(*a*) and 1(*b*) are schematic and waveform diagrams, respectively, of a prior-art inductive validator arrangement;

FIGS. 2(*a*) and 2(*b*) are schematic and waveform diagrams, respectively, of a prior-art multi-capacitive validator arrangement;

FIGS. 3(*a*) and 3(*b*) are schematic and waveform diagrams, respectively, of a prior-art validator arrangement using small inductors;

Figure 6:
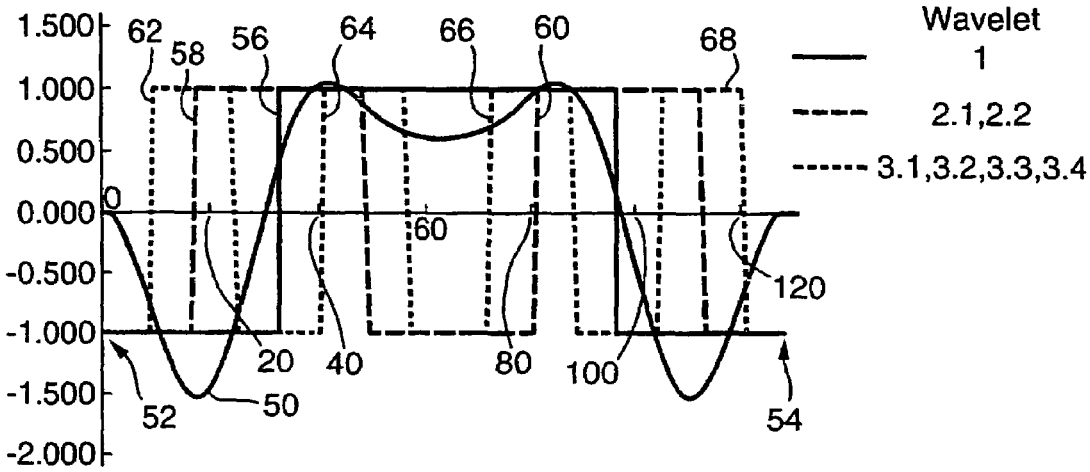
FIG. 6 is a waveform diagram showing the use of a plurality of scaled wavelets in an embodiment of the present invention.
Figure 7A:
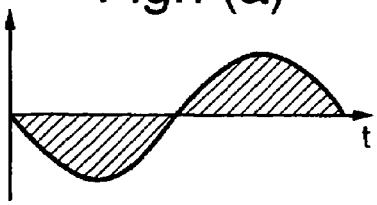
Figure 7B:
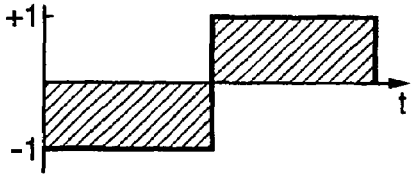
Figure 7C:
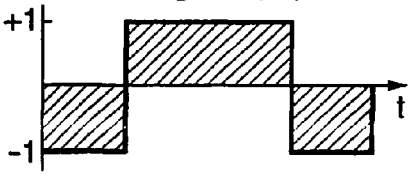
Figure 8:
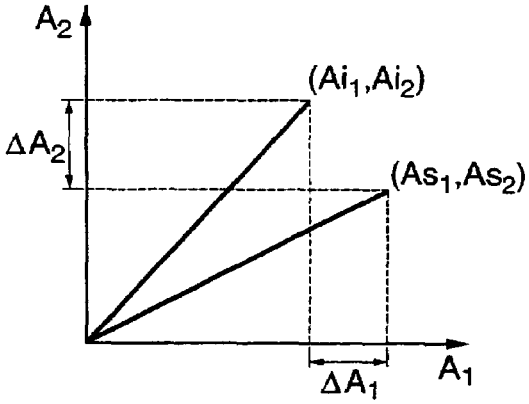
Figure 9:
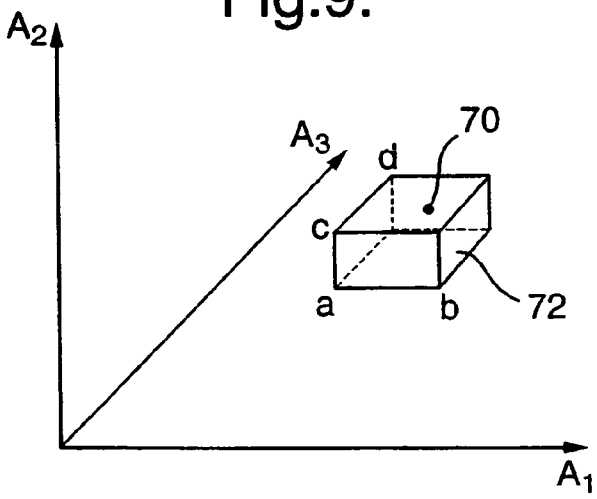
Figure 10:
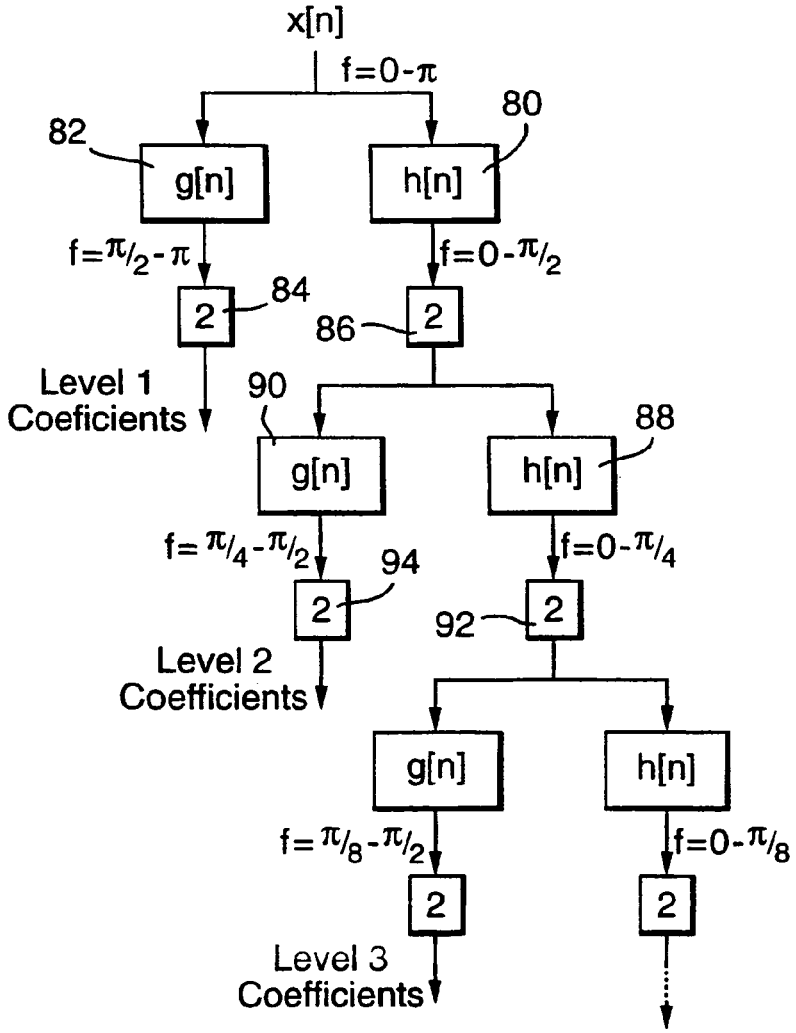

FIGS. 7(*a*), (*b*) and (*c*) show different wavelet shapes, one of which is used in FIG. 6;

FIG. 8 is a two-dimensional "A"-space diagram relevant to one method of evaluating coins from the derived evaluation coefficients;

FIG. 9 is a three-dimensional "A"-space diagram relevant to a second method of evaluating coins from the derived evaluation coefficients, and FIG. 10 is a flow diagram illustrating a further embodiment of the invention.

Figure 1A:
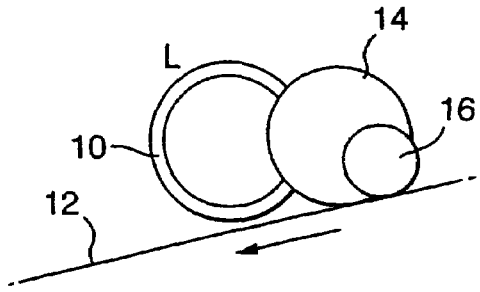
Figure 1B:
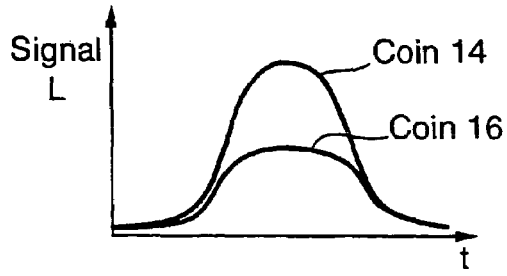
Figure 2A:
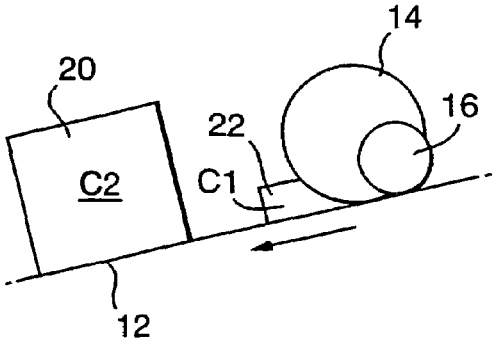
Figure 2B:
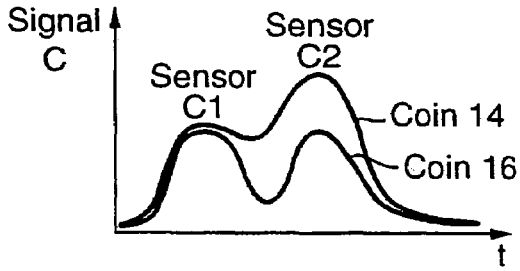
Figure 3A:
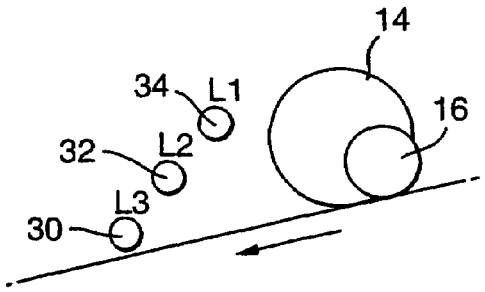
Figure 3B:
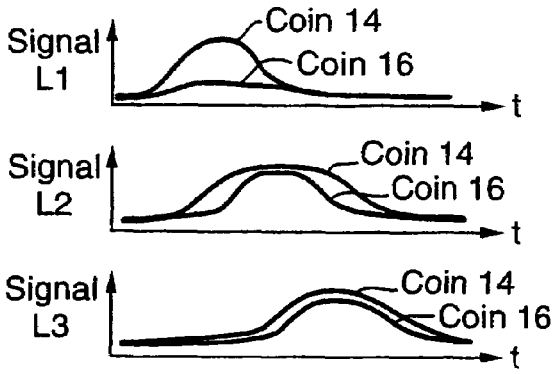
Figure 4:
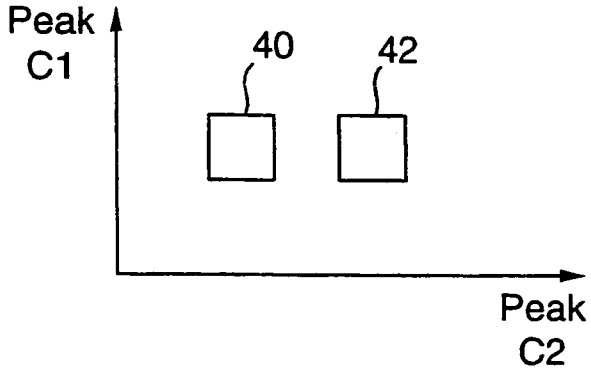
FIG. 4 is a two-dimensional-space diagram corresponding to the arrangement of FIG. 2.

An embodiment of a coin-validation arrangement according to the invention comprises a coin mechanism and associated coin sensors in a configuration such as that shown in FIG. 3 and which is described in greater detail in the applicants' UK patent application published as GB 2,331,614 on 26 May 1999. Thus in the preferred embodiment a series of inductors, which are small relative to the diameter of the smallest coin to be validated, are employed in a given pattern along the coin path and at various heights from the coin-chute floor. As already mentioned in connection with the known validation arrangements, the sensors—in this case the inductors—are employed as part of an oscillator circuit in which disturbance of the sensors' parameters—in this case, their inductance—is reflected in a change in the frequency of operation of the oscillator. These changes are exemplified in FIG. 3(*b*). It is to be appreciated that, in practice, a combination of inductors and capacitor plates may be used instead, or even just capacitor plates. However, in the interest of measurement precision, and in particular the desirability of being able to detect bi-metallic coins, the use of some small inductors is preferred.

Figure 5A:
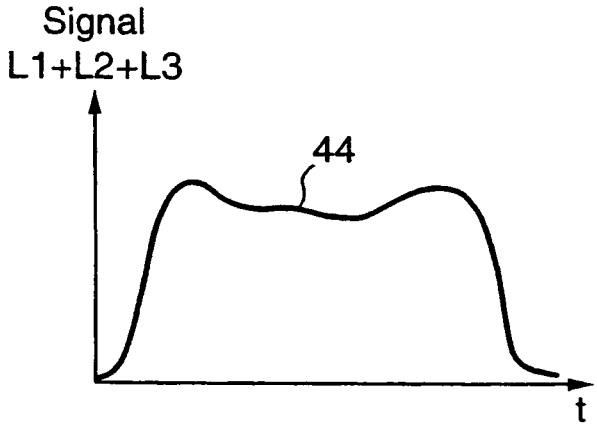
FIG. 5(*a*) is a waveform diagram relating to the multi-inductor arrangement of FIG. 3(*a*) and FIG. 5(*b*) shows arbitrary detector-signal waveforms relating to the wavelet-analysis technique of the present invention.
Figure 5B:
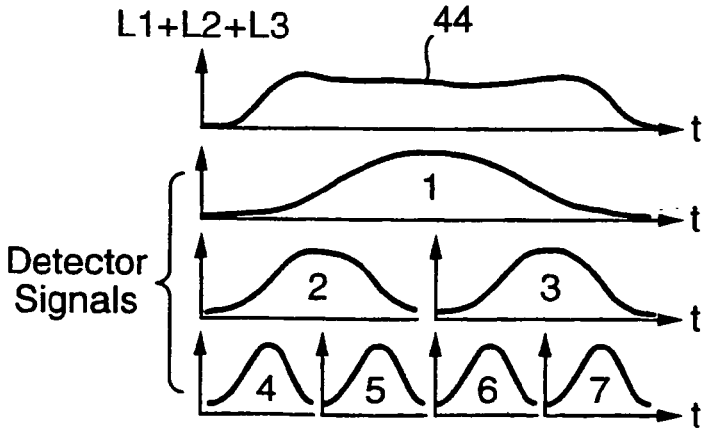

The frequency-change signals associated with the inductors are combined, e.g. connected in series with each other, so that, taking as an example the inductor arrangement shown in FIGS. 3(*a*) and 3(*b*), the resultant signal for coin 14 is as shown in FIG. 5(*a*). The frequency of oscillation is periodically sampled between a start point and a stop point to yield a number of samples between those points. Each of the sample values is correlated with corresponding sample values of a selected "detector" waveform, an arbitrarily representative shape only of which is shown in FIG. 5(*b*) and labelled in that diagram as wave-form 1. In order to increase precision, the signal is also correlated with corresponding sample values of temporally narrower (i.e. "scaled", to use the terminology current in the field) detector waveforms. In the case of FIG. 5(*b*), waveforms 2, 3, 4, 5, 6 and 7 are all correlated with signal 44.

Waveforms 1 to 7 may be wavelets in the conventional sense of the term (i.e. having a zero integral value) or one or more of them may be merely waveshapes corresponding to square integrable functions (see later). In the latter case, different waveshapes may be employed for different ones of waveforms 1 to 7. In either case, where the same waveshape is used throughout, waveshape 1 (the "mother waveshape") is used as the template for several so-called "daughter" waveshapes, which have the same shape as the mother waveshape, but differ in width or duration (so-called "scale") and temporal position (so-called "translation"). These daughter waveshapes are waveforms 2 and 3 in the second level and 4, 5, 6 and 7 in the third level. Scaling may or may not be dyadic (i.e. using factors of 2). Where non-dyadic scaling is employed orthogonality may be prejudiced, as may be the case also with certain choices for the translational positioning of the daughter waveshapes along the time access The technique will be further described now with the aid of an actual numerical example (see FIG. 6 and Table 1).

In FIG. 6 a combined signal associated with the summed sensor output signals is shown as waveform 50. This waveform consists of a finite number of samples (not shown, but in this case 128) taken between a start- and an end-point 52, 54 along the horizontal time axis and is suitably scaled in terms of amplitude (vertical axis) so as to fit between given amplitude limits on the vertical axis. In the preferred embodiment, sampling is started when the coin passes a first sensor (e.g. an optical sensor), is stopped when the coin passes a second sensor (similarly optical) and is then subjected to a procedure which provides a predetermined fixed number of samples. This is done by adding sample values by interpolation between, e.g., neighbouring values where there are too few samples (due to the coin running "too fast" down the coin runway) and, conversely, deleting sample values where there are too many (due to the coin running "too slowly" down the runway). Alternatively, the number of sample values for the input coin may be allowed to vary, while the number of sample values for the wavelets is correspondingly adjusted to that input-coin number, as just described.

Against the sensor-related waveform 50 are shown seven wavelet waveforms, which in this case have a squarewave appearance. This wavelet waveform as a function of time (w(t)) obeys the rule that $$\int_{-\infty}^{\infty} w(t)dt = 0$$

which is satisfied by the examples shown in FIGS. 7(*a*), (*b*) and (*c*) inasmuch as in all these cases the sum of the areas contained within the function below the time axis is equal to the sum of the areas above the time axis. They also obey a square-integral condition explained later. The wavelet selected for the FIG. 6 example is FIG. 7(*c*).

Wavelet 56 is the mother wavelet 1, which is positioned roughly centrally with respect to the signal waveform 50; wavelets 58 and 60 are second-generation daughter wavelets (relabelled for clarity now as 2.1 and 2.2) at half-scale (i.e. having half the width of the mother wavelet) and arranged continguously along the time-axis and symmetrically with respect to the mother wavelet, and wavelets 62, 64, 66 and 68 are third-generation daughter wavelets (relabelled as 3.1, 3.2, 3.3 and 3.4) at quarter-scale (one-quarter the width of the mother wavelet) and again arranged symmetrically with respect to the mother wavelet. The half/quarter scaling and time-axis shifting ("translations") of these daughter wavelets is such as to give rise to orthogonality in this particular embodiment of the invention. However, as will be seen later, other arrangements of the detector waveforms are possible.

Table 1, included at the end of this description, lists for each of the sample points 1–128 the corresponding signal amplitude value (which may be, as explained above, a scaled frequency value, scaling in this sense referring to the reduction or magnification of the signal amplitude in order to bring it within a certain range) and also, under the "Wavelets" column, the amplitude value of the various wavelets. The latter amplitude values are either −1, 0 or 1. Finally, under the "Correlation calculations" column there appears the result of a simple multiplication of each of the signal-sample values with each of the "detector" wavelet values for the same respective point in time.

In the preferred embodiment the results in each sub-column under the "Correlation calculations" column are added together to yield a single resultant value, which will be termed an evaluation coefficient. The whole set of evaluation coefficients forms an evaluation vector, which is as follows:

| | Wavelets | | | | | | |
|---|---|---|---|---|---|---|---|
| | 1 | 2.1 | 2.2 | 3.1 | 3.2 | 3.3 | 3.4 |
| Evaluation Coefficients | 100.45 | 2.104 | −2.104 | −15.947 | 2.717 | 3.764 | −14.901 |

Continuing with terminology, the whole set of signal sample-values constitutes a signal vector, each set of wavelet values a detection vector and each set of correlation-calculation values a correlation vector.

The evaluation vector (having values 100.45, 2.104, −2.104, −15.947, 2.717, 3.764 and −14.901) is now compared with the coefficients of a corresponding vector relating to the values to be expected from each coin in a set of "good" coins for which validation is required. This vector, which is determined experimentally, will be termed a "sample-coin vector". A single value is produced from this comparison procedure signing either acceptance or rejection of the input coin.

In order to allow for an unavoidable spread of"good coin" values, either the evaluation vector is compared with a number of sample-coin vectors relating to different actual good coins, thereby providing a corresponding number of single values each giving a "pass/fail" result, in which case a definitive "pass" may be indicated if all values, or a selected number of values, show "pass"; or the evaluation vector is compared with a single sample-coin vector which is an average of a number of vectors relating to several real coins and the resultant "pass/fail" indication is derived on the basis of an acceptable deviation of the evaluation vector from the single sample-coin vector.

One specific way of performing evaluation and at the same time dealing with the value-deviation (spread) problem posed by differences between real coins is now described with reference to FIG. 8.

In FIG. 8, for simplicity only two evaluation coefficients—corresponding to two wavelets—are taken into account. These coefficients are termed $A_1$ and $A_2$ and occupy a two-dimensional "A"-plane in FIG. 8. The input-coin evaluation coefficients are defined as $Ai_1$ and $Ai_2$, respectively, while the sample-coin coefficients are defined as $As_1$ and $As_2$, respectively. It is desired to evaluate the difference between the input-coin point $Ai_1$, $Ai_2$ and the sample-coin point $As_1$, $As_2$ in such a way as to provide a single value. One possible way of doing this is to take the square of the differences between corresponding values on the two axes, i.e.:

$$f=\Delta A_1^2+\Delta A_2^2=(Ai_1-As_1)^2+(Ai_2-As_2)^2$$

This is repeated for different s coefficients corresponding to different coins in the required set of coins for which the validator is to be used. The value of this function is defined as a "pass" for a particular coin if it falls within a prescribed range of values which allows, as described above, for spreads in coin characteristics.

In practice there will usually be more than two coefficients involved, and indeed the embodiment being described employs seven. In this case the same operation is carried out in a seven-dimensional "A-plane", with the function being defined as:

$$f=(Ai_1-As_1)^2+(Ai_2-As_2)^2+\ldots+(Ai_7-As_7)^2$$

This can clearly be extended to any number of coefficients, n, as required, to yield the following function which also includes a useful weighting facility:

$$f=w_1(Ai_1-As_1)^2+w_2(Ai_2-As_2)^2+\ldots+w_n(Ai_n-As_n)^2$$

The weighting coefficients $w_{1\ldots n}$ may assume values between zero and unity depending on the spread of values caused to certain coefficients by examples of real coins. Thus if a particular real coin had, for example, a particularly wide spread of $A_2$ values compared with $A_1$ values, for example, for that coin the $A_2$ coefficient might be de-emphasised by making the value of the $w_2$ coefficient less than unity and closer to zero.

A simpler alternative evaluation method which could be employed would be to set up predetermined fixed limits in each dimension of the multi-dimensional "A-plane", which limits would then define a "pass" region of that plane for a particular coin. This is illustrated in FIG. 9, in which it assumed that an arrangement employing three evaluation coefficients is employed, giving rise to a three-dimensional "A"-space having orthogonal axes $A_1$, $A_2$, $A_3$. A particular input-coin signal produces coefficients $Ai_1$, $Ai_2$, $Ai_3$ which maps to a particular point 70 in "A"-space, as shown. For each coin for which validation is required a three-dimensional "pass" volume 72 is defined by the setting of predetermined range limits a, b, c, d. If point 70 comes within that volume, the input coin is accepted as being one of the allowable set of coins.

The predetermined limits will normally be defined with reference to empirically derived values $Ai_1$, $Ai_2$, $Ai_3$ for a number of real input coins such as to ensure that the particular coin in question will be registered correctly to an acceptable degree of reliability. More concretely, an average position for point 70 may be ascertained by testing a number of real coins of the same denomination and either arbitrarily or statistically derived deviations then defined to give rise to the distances a-b, a-c and c-d.

Whatever the evaluation method used—and the above are only two possible methods—the function and the thresholds for determining whether or not a particular input coin belongs to a coin set should be chosen to avoid the possibility that an input coin could be identified as one of two or more real coins. However, such an overlap could also be resolved by rejecting such multiply-identified coins. This would also be appropriate if one of the "overlapping" coins was a "slug" (piece of metal used as a substitute for a coin) or a known invalid coin.

It should be noted that, although the wavelets have been spoken of as being "temporally scaled" and occupying particular positions along a time-axis and appear to be present for particular "time durations" along that axis, this should not automatically be taken to imply that these wavelets are actual signals which are processed in real time in the same way as the input-coin waveform 50 is an actual signal processed in real time. In practice, the wavelet samples are most likely to be merely computer-generated values which are processed with the input-coin samples to provide the correlation vectors. There need be no actual "sampling" of a wavelet signal as such. Indeed, these sample values are as much related to distance travelled by the input coin as they are to time. Thus each wavelet "sample" value may be thought of as corresponding to a particular point along the coin runway occupied by the coin. A validation system could be conceived in which the wavelets were real signals which were sampled in the same way and at the same rate as the input-coin signal but this would require considerable outlay in hardware and would be less efficient than the preferred software realisation.

While the above description has concentrated on one preferred embodiment involving true wavelets, another embodiment employs wavelet analysis in a different way, which has the drawback of not being as easily implemented as the preferred embodiment. In this alternative embodiment, a discrete wavelet transform (DWT) is carried out using a series of filtering functions to arrive at a vector of DWT coefficients. The process is illustrated in FIG. 10 and starts by passing the sampled input-coin signal x[n], which is assumed to contain a range of frequencies between 0 and π radians, through a half-band low-pass filter 80 and a halfband high-pass filter 82, which perform scaling and wavelet functions, respectively. These and subsequent corresponding filters have an impulse response g[n] and h[n] for high-pass and low-pass, respectively, and effectively decompose the original signal into its wavelet coefficients, as will now be explained.

Since the high-pass filter 82 has at its output a signal at only half the original highest frequency, namely π/2, the number of sample values present at both the high-pass and low-pass filters can, under the Nyquist rule, be eliminated; this is a process called "subsampling". Present, therefore, at the output of the subsampling stage 84 is a series of "Level 1" DWT coefficients.

The low-pass output subsampled at 86 is, in turn, subjected to a low-pass and a high-pass filtering process in low-pass filter 88 and high-pass filter 90, respectively, the outputs of which are, again, subsampled in stages 92 and 94, the output of subsampler 94 forming the "Level 2" DWT coefficients. This process is repeated at successive levels until, on the final level, only one DWT coefficient is present following subsampling. The whole DWT coefficient vector is formed from a concatenation of the coefficients from all the various levels.

As in the preferred embodiment, this vector is compared with a similar sample-coin vector relating to each coin in the required set of coins and a decision is made on the basis of this comparison. A function similar to the weighted "square of the differences" function mentioned earlier can, for example, be employed in this capacity.

In practice, it may be found that, with certain coins in a set, some of the DWT coefficients deliver very little information. If this is the case, it might be possible to safely ignore these coefficients during the evaluation procedure, with a consequent saving in processing power.

It is worth mentioning that, although in many applications involving wavelet analysis the initial signal will be sampled at at least twice the highest frequency expected to be contained in the signal (the "Nyquist limit"), in the present application this is not a strict requirement, since no reconstruction of the initial signal takes place. An additional consideration is that orthogonality between the Wavelet transform bases, which is a desired feature in most applications, is not a requirement in this present application. Orthogonality means that the DWT coefficients do not duplicate information and therefore do not create redundancy. In the present application, however, redundancy is not a problem and can be tolerated to some degree.

As was pointed out in relation to the first, preferred embodiment, the only real-time processed signal will normally be the input-coin signal x[n], which is sampled and the sample values subsequently filtered in software. Subsampling is also a process far more easily carried out in software than in hardware. As with the first embodiment, a hardware realisation of both the filtering and subsampling functions is conceivable, but will have severe drawbacks in comparison with the software realisation.

A realisation of the invention involving waveform correlations but not involving orthogonality is achieved by employing detector waveforms which do not have time-axis shifts ("tanslations") such as to lead to orthogonality and/or do not employ dyadic scaling. Such waveforms may be positioned along the time axis in fairly arbitrary ways, though it will often be desirable to ensure that the positioning used places the detector waveforms near peaks in the incoming signal 50. At all events, it would be unwise to have detector waveforms spaced apart by much less than the conventionally used orthogonal shift, since there would then occur much computation involving similar information, resulting in high redundancy.

The detector waveforms are not actually required to be true wavelets at all, but may be any waveshape, provided the integral of the function defining that waveshape has a finite value. More precisely, the waveshape function, which shall be called f(t), should obey the relationship:

$$\int_{-\infty}^{\infty} f^2(t)dt \text{ is finite.}$$

It is also not necessary to employ the same waveshape throughout the procedure, but a different shape can be used for the second-level detector waveforms than for the thirdlevel, for example, or different shapes could even be used within the same level.

Factors in the above-described techniques which are to be predetermined by the validator designer are, firstly, the exact shape of the wavelets to be used and whether the same shape is used throughout, or different ones and, secondly, whether or not any of the correlation coefficients or evaluation coefficients are to be ignored, because they contribute little to the overall evaluation. This latter factor has already been addressed above in connection with the weighting function and with the possibility of ignoring some DWT coefficients. Suffice it to say that, the more information that can be discarded, the better, since computing time is then reduced and the whole validation process becomes more efficient. As regards the former factor, it may be found that some detector waveshapes suit some coin sets better than other detector waveshapes, so that different shapes may be employed for different countries, for example. The criterion for choice is always that the waveshape(s) chosen should provide good discrimination between coins in a particular set. The final choice will in practice, usually be empirically arrived at.

An important advantage of the present technique is the possibility of readily accommodating new coins into an existing set simply by changing the software (e.g. by altering the weighting in the evaluation function or the form of the evaluation function itself). This contrasts with the situation with existing validator arrangements, in which accommodation of new coins will often require extensive and expensive hardware changes. A further attractive feature is the possibility of deriving accurate information about the input-coin signal and thereby allowing accurate validation, using relatively little processing overhead, due to the possibility, at least in most cases, of discarding non-useful coefficients.

TABLE 1

| | | Wavelets | | | | | | | Correlation calculations | | | | | | |
|---|---|---|---|---|---|---|---|---|---|---|---|---|---|---|---|
| Point | Signal | 1 | 2.1 | 2.2 | 3.1 | 3.2 | 3.3 | 3.4 | 1 | 2.1 | 2.2 | 3.1 | 3.2 | 3.3 | 3.4 |
| 1 | −0.012 | −1 | −1 | | −1 | | | | 0.012 | 0.012 | 0 | 0.012 | 0 | 0 | 0 |
| 2 | −0.048 | −1 | −1 | | −1 | | | | 0.048 | 0.048 | 0 | 0.048 | 0 | 0 | 0 |
| 3 | −0.107 | −1 | −1 | | −1 | | | | 0.107 | 0.107 | 0 | 0.107 | 0 | 0 | 0 |
| 4 | −0.187 | −1 | −1 | | −1 | | | | 0.187 | 0.187 | 0 | 0.187 | 0 | 0 | 0 |
| 5 | −0.285 | −1 | −1 | | −1 | | | | 0.285 | 0.285 | 0 | 0.285 | 0 | 0 | 0 |
| 6 | −0.398 | −1 | −1 | | −1 | | | | 0.398 | 0.398 | 0 | 0.398 | 0 | 0 | 0 |
| 7 | −0.523 | −1 | −1 | | −1 | | | | 0.523 | 0.523 | 0 | 0.523 | 0 | 0 | 0 |
| 8 | −0.656 | −1 | −1 | | −1 | | | | 0.656 | 0.656 | 0 | 0.656 | 0 | 0 | 0 |
| 9 | −0.792 | −1 | −1 | | 1 | | | | 0.792 | 0.792 | 0 | −0.792 | 0 | 0 | 0 |
| 10 | −0.928 | −1 | −1 | | 1 | | | | 0.928 | 0.928 | 0 | −0.928 | 0 | 0 | 0 |
| 11 | −1.059 | −1 | −1 | | 1 | | | | 1.059 | 1.059 | 0 | −1.059 | 0 | 0 | 0 |
| 12 | −1.180 | −1 | −1 | | 1 | | | | 1.18 | 1.18 | 0 | −1.18 | 0 | 0 | 0 |
| 13 | −1.288 | −1 | −1 | | 1 | | | | 1.288 | 1.288 | 0 | −1.288 | 0 | 0 | 0 |
| 14 | −1.380 | −1 | −1 | | 1 | | | | 1.38 | 1.38 | 0 | −1.38 | 0 | 0 | 0 |
| 15 | −1.452 | −1 | −1 | | 1 | | | | 1.452 | 1.452 | 0 | −1.452 | 0 | 0 | 0 |
| 16 | −1.502 | −1 | −1 | | 1 | | | | 1.502 | 1.502 | 0 | −1.502 | 0 | 0 | 0 |
| 17 | −1.528 | −1 | 1 | | 1 | | | | 1.528 | −1.528 | 0 | −1.528 | 0 | 0 | 0 |
| 18 | −1.529 | −1 | 1 | | 1 | | | | 1.529 | −1.529 | 0 | −1.529 | 0 | 0 | 0 |
| 19 | −1.504 | −1 | 1 | | 1 | | | | 1.504 | −1.504 | 0 | −1.504 | 0 | 0 | 0 |
| 20 | −1.454 | −1 | 1 | | 1 | | | | 1.454 | −1.454 | 0 | −1.454 | 0 | 0 | 0 |
| 21 | −1.380 | −1 | 1 | | 1 | | | | 1.38 | −1.38 | 0 | −1.38 | 0 | 0 | 0 |
| 22 | −1.283 | −1 | 1 | | 1 | | | | 1.283 | −1.283 | 0 | −1.283 | 0 | 0 | 0 |
| 23 | −1.165 | −1 | 1 | | 1 | | | | 1.165 | −1.165 | 0 | −1.165 | 0 | 0 | 0 |
| 24 | −1.029 | −1 | 1 | | 1 | | | | 1.029 | −1.029 | 0 | −1.029 | 0 | 0 | 0 |
| 25 | −0.879 | −1 | 1 | | −1 | | | | 0.879 | −0.879 | 0 | 0.879 | 0 | 0 | 0 |
| 26 | −0.717 | −1 | 1 | | −1 | | | | 0.717 | −0.717 | 0 | 0.717 | 0 | 0 | 0 |
| 27 | −0.546 | −1 | 1 | | −1 | | | | 0.546 | −0.546 | 0 | 0.546 | 0 | 0 | 0 |
| 28 | −0.372 | −1 | 1 | | −1 | | | | 0.372 | −0.372 | 0 | 0.372 | 0 | 0 | 0 |
| 29 | −0.197 | −1 | 1 | | −1 | | | | 0.197 | −0.197 | 0 | 0.197 | 0 | 0 | 0 |
| 30 | −0.024 | −1 | 1 | | −1 | | | | 0.024 | −0.024 | 0 | 0.024 | 0 | 0 | 0 |
| 31 | 0.142 | −1 | 1 | | −1 | | | | −0.142 | 0.142 | 0 | −0.142 | 0 | 0 | 0 |
| 32 | 0.300 | −1 | 1 | | −1 | | | | −0.3 | 0.3 | 0 | −0.3 | 0 | 0 | 0 |
| 33 | 0.446 | 1 | 1 | | | −1 | | | 0.446 | 0.446 | 0 | 0 | −0.446 | 0 | 0 |
| 34 | 0.578 | 1 | 1 | | | −1 | | | 0.578 | 0.578 | 0 | 0 | −0.578 | 0 | 0 |
| 35 | 0.695 | 1 | 1 | | | −1 | | | 0.695 | 0.695 | 0 | 0 | −0.695 | 0 | 0 |
| 36 | 0.796 | 1 | 1 | | | −1 | | | 0.796 | 0.796 | 0 | 0 | −0.796 | 0 | 0 |
| 37 | 0.880 | 1 | 1 | | | −1 | | | 0.88 | 0.88 | 0 | 0 | −0.88 | 0 | 0 |
| 38 | 0.948 | 1 | 1 | | | −1 | | | 0.946 | 0.946 | 0 | 0 | −0.946 | 0 | 0 |
| 39 | 0.996 | 1 | 1 | | | −1 | | | 0.996 | 0.996 | 0 | 0 | −0.996 | 0 | 0 |
| 40 | 1.029 | 1 | 1 | | | −1 | | | 1.029 | 1.029 | 0 | 0 | −1.029 | 0 | 0 |
| 41 | 1.048 | 1 | 1 | | | 1 | | | 1.048 | 1.048 | 0 | 0 | 1.048 | 0 | 0 |
| 42 | 1.053 | 1 | 1 | | | 1 | | | 1.053 | 1.053 | 0 | 0 | 1.053 | 0 | 0 |
| 43 | 1.047 | 1 | 1 | | | 1 | | | 1.047 | 1.047 | 0 | 0 | 1.047 | 0 | 0 |
| 44 | 1.030 | 1 | 1 | | | 1 | | | 1.03 | 1.03 | 0 | 0 | 1.03 | 0 | 0 |
| 45 | 1.005 | 1 | 1 | | | 1 | | | 1.005 | 1.005 | 0 | 0 | 1.005 | 0 | 0 |
| 46 | 0.975 | 1 | 1 | | | 1 | | | 0.975 | 0.975 | 0 | 0 | 0.975 | 0 | 0 |
| 47 | 0.940 | 1 | 1 | | | 1 | | | 0.94 | 0.94 | 0 | 0 | 0.94 | 0 | 0 |
| 48 | 0.902 | 1 | 1 | | | 1 | | | 0.902 | 0.902 | 0 | 0 | 0.902 | 0 | 0 |
| 49 | 0.864 | 1 | −1 | | | 1 | | | 0.864 | −0.864 | 0 | 0 | 0.864 | 0 | 0 |
| 50 | 0.826 | 1 | −1 | | | 1 | | | 0.826 | −0.826 | 0 | 0 | 0.826 | 0 | 0 |
| 51 | 0.790 | 1 | −1 | | | 1 | | | 0.79 | −0.79 | 0 | 0 | 0.79 | 0 | 0 |
| 52 | 0.756 | 1 | −1 | | | 1 | | | 0.756 | −0.756 | 0 | 0 | 0.756 | 0 | 0 |
| 53 | 0.725 | 1 | −1 | | | 1 | | | 0.725 | −0.725 | 0 | 0 | 0.725 | 0 | 0 |
| 54 | 0.699 | 1 | −1 | | | 1 | | | 0.699 | −0.699 | 0 | 0 | 0.699 | 0 | 0 |
| 55 | 0.675 | 1 | −1 | | | 1 | | | 0.675 | −0.675 | 0 | 0 | 0.675 | 0 | 0 |
| 56 | 0.656 | 1 | −1 | | | 1 | | | 0.656 | −0.656 | 0 | 0 | 0.656 | 0 | 0 |
| 57 | 0.640 | 1 | −1 | | | −1 | | | 0.64 | −0.64 | 0 | 0 | −0.64 | 0 | 0 |
| 58 | 0.628 | 1 | −1 | | | −1 | | | 0.628 | −0.628 | 0 | 0 | −0.628 | 0 | 0 |
| 59 | 0.618 | 1 | −1 | | | −1 | | | 0.618 | −0.618 | 0 | 0 | −0.618 | 0 | 0 |
| 60 | 0.611 | 1 | −1 | | | −1 | | | 0.611 | −0.611 | 0 | 0 | −0.611 | 0 | 0 |
| 61 | 0.606 | 1 | −1 | | | −1 | | | 0.606 | −0.606 | 0 | 0 | −0.606 | 0 | 0 |
| 62 | 0.602 | 1 | −1 | | | −1 | | | 0.602 | −0.602 | 0 | 0 | −0.602 | 0 | 0 |
| 63 | 0.601 | 1 | −1 | | | −1 | | | 0.601 | −0.601 | 0 | 0 | −0.601 | 0 | 0 |
| 64 | 0.600 | 1 | −1 | | | −1 | | | 0.6 | −0.6 | 0 | 0 | −0.6 | 0 | 0 |
| 65 | 0.601 | 1 | | −1 | | | −1 | | 0.601 | 0 | −0.601 | 0 | 0 | −0.601 | 0 |
| 66 | 0.602 | 1 | | −1 | | | −1 | | 0.602 | 0 | −0.602 | 0 | 0 | −0.602 | 0 |
| 67 | 0.606 | 1 | | −1 | | | −1 | | 0.606 | 0 | −0.606 | 0 | 0 | −0.606 | 0 |
| 68 | 0.611 | 1 | | −1 | | | −1 | | 0.611 | 0 | −0.611 | 0 | 0 | −0.611 | 0 |
| 69 | 0.618 | 1 | | −1 | | | −1 | | 0.618 | 0 | −0.618 | 0 | 0 | −0.618 | 0 |
| 70 | 0.628 | 1 | | −1 | | | −1 | | 0.628 | 0 | −0.628 | 0 | 0 | −0.628 | 0 |
| 71 | 0.640 | 1 | | −1 | | | −1 | | 0.64 | 0 | −0.64 | 0 | 0 | −0.64 | 0 |
| 72 | 0.656 | 1 | | −1 | | | −1 | | 0.656 | 0 | −0.656 | 0 | 0 | −0.656 | 0 |
| 73 | 0.675 | 1 | | −1 | | | 1 | | 0.675 | 0 | −0.675 | 0 | 0 | 0.675 | 0 |
| 74 | 0.699 | 1 | | −1 | | | 1 | | 0.699 | 0 | −0.699 | 0 | 0 | 0.699 | 0 |
| 75 | 0.725 | 1 | | −1 | | | 1 | | 0.725 | 0 | −0.725 | 0 | 0 | 0.725 | 0 |

TABLE 1-continued

| | | Wavelets | | | | | | | Correlation calculations | | | | | | |
|---|---|---|---|---|---|---|---|---|---|---|---|---|---|---|---|
| Point | Signal | 1 | 2.1 | 2.2 | 3.1 | 3.2 | 3.3 | 3.4 | 1 | 2.1 | 2.2 | 3.1 | 3.2 | 3.3 | 3.4 |
| 76 | 0.756 | 1 | | −1 | | | 1 | | 0.756 | 0 | −0.756 | 0 | 0 | 0.756 | 0 |
| 77 | 0.790 | 1 | | −1 | | | 1 | | 0.79 | 0 | −0.79 | 0 | 0 | 0.79 | 0 |
| 78 | 0.826 | 1 | | −1 | | | 1 | | 0.826 | 0 | −0.826 | 0 | 0 | 0.826 | 0 |
| 79 | 0.864 | 1 | | −1 | | | 1 | | 0.864 | 0 | −0.864 | 0 | 0 | 0.864 | 0 |
| 80 | 0.902 | 1 | | −1 | | | 1 | | 0.902 | 0 | −0.902 | 0 | 0 | 0.902 | 0 |
| 81 | 0.940 | 1 | | 1 | | | 1 | | 0.94 | 0 | 0.94 | 0 | 0 | 0.94 | 0 |
| 82 | 0.975 | 1 | | 1 | | | 1 | | 0.975 | 0 | 0.975 | 0 | 0 | 0.975 | 0 |
| 83 | 1.005 | 1 | | 1 | | | 1 | | 1.005 | 0 | 1.005 | 0 | 0 | 1.005 | 0 |
| 84 | 1.030 | 1 | | 1 | | | 1 | | 1.03 | 0 | 1.03 | 0 | 0 | 1.03 | 0 |
| 85 | 1.047 | 1 | | 1 | | | 1 | | 1.047 | 0 | 1.047 | 0 | 0 | 1.047 | 0 |
| 86 | 1.053 | 1 | | 1 | | | 1 | | 1.053 | 0 | 1.053 | 0 | 0 | 1.053 | 0 |
| 87 | 1.048 | 1 | | 1 | | | 1 | | 1.048 | 0 | 1.048 | 0 | 0 | 1.048 | 0 |
| 88 | 1.029 | 1 | | 1 | | | 1 | | 1.029 | 0 | 1.029 | 0 | 0 | 1.029 | 0 |
| 89 | 0.996 | 1 | | 1 | | | −1 | | 0.996 | 0 | 0.996 | 0 | 0 | −0.996 | 0 |
| 90 | 0.946 | 1 | | 1 | | | −1 | | 0.946 | 0 | 0.946 | 0 | 0 | −0.946 | 0 |
| 91 | 0.880 | 1 | | 1 | | | −1 | | 0.88 | 0 | 0.88 | 0 | 0 | −0.88 | 0 |
| 92 | 0.796 | 1 | | 1 | | | −1 | | 0.796 | 0 | 0.796 | 0 | 0 | −0.796 | 0 |
| 93 | 0.695 | 1 | | 1 | | | −1 | | 0.695 | 0 | 0.695 | 0 | 0 | −0.695 | 0 |
| 94 | 0.578 | 1 | | 1 | | | −1 | | 0.578 | 0 | 0.578 | 0 | 0 | −0.578 | 0 |
| 95 | 0.446 | 1 | | 1 | | | −1 | | 0.446 | 0 | 0.446 | 0 | 0 | −0.446 | 0 |
| 96 | 0.300 | 1 | | 1 | | | −1 | | 0.3 | 0 | 0.3 | 0 | 0 | −0.3 | 0 |
| 97 | 0.142 | −1 | | 1 | | | | −1 | −0.142 | 0 | 0.142 | 0 | 0 | 0 | −0.142 |
| 98 | −0.024 | −1 | | 1 | | | | −1 | 0.024 | 0 | −0.024 | 0 | 0 | 0 | 0.024 |
| 99 | −0.197 | −1 | | 1 | | | | −1 | 0.197 | 0 | −0.197 | 0 | 0 | 0 | 0.197 |
| 100 | −0.372 | −1 | | 1 | | | | −1 | 0.372 | 0 | −0.372 | 0 | 0 | 0 | 0.372 |
| 101 | −0.546 | −1 | | 1 | | | | −1 | 0.546 | 0 | −0.546 | 0 | 0 | 0 | 0.546 |
| 102 | −0.717 | −1 | | 1 | | | | −1 | 0.717 | 0 | −0.717 | 0 | 0 | 0 | 0.717 |
| 103 | −0.879 | −1 | | 1 | | | | −1 | 0.879 | 0 | −0.879 | 0 | 0 | 0 | 0.879 |
| 104 | −1.029 | −1 | | 1 | | | | −1 | 1.029 | 0 | −1.029 | 0 | 0 | 0 | 1.029 |
| 105 | −1.165 | −1 | | 1 | | | | 1 | 1.165 | 0 | −1.165 | 0 | 0 | 0 | −1.165 |
| 106 | −1.283 | −1 | | 1 | | | | 1 | 1.283 | 0 | −1.283 | 0 | 0 | 0 | −1.283 |
| 107 | −1.380 | −1 | | 1 | | | | 1 | 1.38 | 0 | −1.38 | 0 | 0 | 0 | −1.38 |
| 108 | −1.454 | −1 | | 1 | | | | 1 | 1.454 | 0 | −1.454 | 0 | 0 | 0 | −1.454 |
| 109 | −1.504 | −1 | | 1 | | | | 1 | 1.504 | 0 | −1.504 | 0 | 0 | 0 | −1.504 |
| 110 | −1.529 | −1 | | 1 | | | | 1 | 1.529 | 0 | −1.529 | 0 | 0 | 0 | −1.529 |
| 111 | −1.528 | −1 | | 1 | | | | 1 | 1.528 | 0 | −1.528 | 0 | 0 | 0 | −1.528 |
| 112 | −1.502 | −1 | | 1 | | | | 1 | 1.502 | 0 | −1.502 | 0 | 0 | 0 | −1.502 |
| 113 | −1.452 | −1 | | −1 | | | | 1 | 1.452 | 0 | 1.452 | 0 | 0 | 0 | −1.452 |
| 114 | −1.380 | −1 | | −1 | | | | 1 | 1.38 | 0 | 1.38 | 0 | 0 | 0 | −1.38 |
| 115 | −1.288 | −1 | | −1 | | | | 1 | 1.288 | 0 | 1.288 | 0 | 0 | 0 | −1.288 |
| 116 | −1.180 | −1 | | −1 | | | | 1 | 1.18 | 0 | 1.18 | 0 | 0 | 0 | −1.18 |
| 117 | −1.059 | −1 | | −1 | | | | 1 | 1.059 | 0 | 1.059 | 0 | 0 | 0 | −1.059 |
| 118 | −0.928 | −1 | | −1 | | | | 1 | 0.928 | 0 | 0.928 | 0 | 0 | 0 | −0.928 |
| 119 | −0.792 | −1 | | −1 | | | | 1 | 0.792 | 0 | 0.792 | 0 | 0 | 0 | −0.792 |
| 120 | −0.656 | −1 | | −1 | | | | 1 | 0.656 | 0 | 0.656 | 0 | 0 | 0 | −0.656 |
| 121 | −0.523 | −1 | | −1 | | | | −1 | 0.523 | 0 | 0.523 | 0 | 0 | 0 | 0.523 |
| 122 | −0.398 | −1 | | −1 | | | | −1 | 0.398 | 0 | 0.398 | 0 | 0 | 0 | 0.398 |
| 123 | −0.285 | −1 | | −1 | | | | −1 | 0.285 | 0 | 0.285 | 0 | 0 | 0 | 0.285 |
| 124 | −0.187 | −1 | | −1 | | | | −1 | 0.187 | 0 | 0.187 | 0 | 0 | 0 | 0.187 |
| 125 | −0.107 | −1 | | −1 | | | | −1 | 0.107 | 0 | 0.107 | 0 | 0 | 0 | 0.107 |
| 126 | −0.048 | −1 | | −1 | | | | −1 | 0.048 | 0 | 0.048 | 0 | 0 | 0 | 0.048 |
| 127 | −0.012 | −1 | | −1 | | | | −1 | 0.012 | 0 | 0.012 | 0 | 0 | 0 | 0.012 |
| 128 | 0.000 | −1 | | −1 | | | | −1 | 0 | 0 | 0 | 0 | 0 | 0 | 0 |

The invention claimed is:

1. A method of validating a coin inserted into a coin mechanism having a coin-guide means for guiding an input coin along a predetermined coin path, and one or more coin sensors disposed in the path of the input coin, the method comprising the steps of:

a) sensing an effect of the input coin on a parameter of the one or more sensors and providing an input-coin signal representative of said effect;

b) sampling the input-coin signal to produce a sequence of sample values;

c) multiplying respective values of a plurality of detection waveforms characteristic of a particular coin, each detection waveform being a wavelet and comprising a sequence of numerical values, by those of the input-coin signal to form products;

d) summing the products to produce an evaluation value corresponding to each detection waveform; and e) determining whether each of the evaluation values falls within predetermined limits, in order to validate the coin.

2. The method as claimed in claim 1, and subjecting the input-coin signal to a discrete wavelet transform (DWT)

process which yields a set of transform coefficients, comparing said transform coefficients with a corresponding set of coefficients relating to a sample coin or set of coins, and the determining step being performed on the basis of this comparison.

3. The method as claimed in claim 2, and subjecting the input-coin signal, after being sampled, to low-pass and high-pass filtering and subsequent subsampling by a factor of 2 to yield first subsampled results, the first subsampled results of the high-pass filtering forming a part of the set of transform coefficients; and subjecting the low-pass subsampled values to similar low-pass and high-pass filtering and subsequent subsampling to yield second subsampled results, the second subsampled results of the high-pass filtering likewise forming another part of the transform coefficient set, for a given number of filtering and subsampling operations.

4. The method as claimed in claim 3, wherein a final filtering and subsampling operation occurs when the subsampled high-pass filtering for a stage yields only one coefficient.

5. The method as claimed in claim 3, wherein the filtering and subsampling operations are performed in software.

6. A coin validation arrangement, comprising:

a) a coin-guide means for guiding an input coin along a predetermined coin path;

b) one or more coin sensors disposed in the path of the input coin;

c) a circuit means for sensing an effect of the input coin on a parameter of the one or more sensors and providing an input-coin signal representative of said effect;

d) means for sampling the input-coin signal to produce a sequence of sample values;

e) means for multiplying respective values of a plurality of detection waveforms characteristic of a particular coin, each detection waveform comprising a sequence of numerical values, by those of the input-coin signal to form products, and for summing the products to produce an evaluation value corresponding to each detection waveform, wherein each detection waveforms satisfies the condition $$\int_{-\infty}^{\infty} f^2(t)dt \text{ is finite}$$

where $f(t)$ is a function defining a particular waveform; and f) means of determining whether each of the evaluation values falls within predetermined limits, in order to validate the coin.

7. The validation arrangement as claimed in claim 6, wherein each of the detection waveforms satisfies the condition $$\int_{-\infty}^{\infty} f^2(t)dt = 0$$

where $f(t)$ is a function defining a particular waveform.

8. The validation arrangement as claimed in claim 6, wherein each of the detection waveforms comprises a single first detection-waveform defined by a first sequence of numerical values, and a plurality of detection-waveforms defined by respective sequences of numerical values, the respective sequences being shorter than the first sequence.

9. The validation arrangement as claimed in claim 8, wherein the plurality of detection-waveforms comprises two second detection-waveforms having respective second sequences shorter than the first sequence, and four third detection-waveforms having respective third sequences shorter than the second sequences.

10. The validation arrangement as claimed in claim 9, wherein the second sequences are equal to each other, and wherein the third sequences are equal to each other.

11. The validation arrangement as claimed in claim 10, wherein the second sequences are one-half the length of the first sequence, and wherein the third sequences are one-half the length of the second sequences.

12. The validation arrangement as claimed in claim 11, wherein the second sequences follow directly on from each other, and wherein the third sequences follow directly on from each other.

13. The validation arrangement as claimed in claim 8, wherein one or more of said sequences is extended such that it contains a number of values equal to a number of samples in the sampled input-coin signal, said values lying outside a core of values which define a particular detection waveform having a value of zero.

14. The validation arrangement as claimed in claim 6, wherein the plurality of detection waveforms is chosen such as to provide a correlation with the sampled input-coin signal.

15. The validation arrangement as claimed in claim 6, wherein an amplitude of the signal is sampled at a plurality of points in time to form a signal vector, and wherein the signal vector is correlated with one or more detection vectors associated with respective said detection waveforms, thereby to provide respective correlation vectors, one or more of which are used to provide a validation indication.

16. The validation arrangement as claimed in claim 15, wherein coefficients of the one or more correlation vectors are compared with corresponding coefficients of respective reference vectors associated with a sample input coin or set of coins, a result of this comparison being used to provide said validation indication.

17. The validation arrangement as claimed in claim 16, wherein said respective reference vectors are associated with a plurality of sample input coins or set of coins, thereby to determine an acceptable spread of allowable comparison values.

18. The validation arrangement as claimed in claim 15, wherein coefficients of each of the correlation vectors are processed to provide one or more evaluation coefficients, said one or more evaluation coefficients being used to provide said validation indication.

19. The validation arrangement as claimed in claim 18, wherein said one or more evaluation coefficients are compared with corresponding coefficients associated with a sample input coin or set of coins, a result of this comparison being used to provide said validation indication.

20. The validation arrangement as claimed in claim 19, wherein said corresponding coefficients are associated with a plurality of sample input coins or set of coins, thereby to determine an acceptable spread of allowable comparison values.

21. The validation arrangement as claimed in claim 20, wherein said correlation coefficients are processed to provide a single evaluation value.

22. The validation arrangement as claimed in claim 21, wherein said processing of the correlation coefficients comprises a summing together of the correlation coefficients.

23. The validation arrangement as claimed in claim 22, wherein said validation indication is provided on a basis of a function involving said evaluation coefficients and said sample-coin coefficients.

24. The validation arrangement as claimed in claim 23, wherein said function is expressed as:

$$f=w_1(Ai_1-As_1)^2+w_2(Ai_2-As_2)^2+\ldots+w_n\,(Ai_n-As_n)^2$$

where $Ai_{1\text{-}n}$ are n evaluation coefficients of the input coin, $As_{1\text{-}n}$ are n sample-coin coefficients, and $w_{1\text{-}n}$ are n weighting factors associated with the respective evaluation and sample-coin coefficients.

25. The validation arrangement as claimed in claim 6, in which the detection waveforms are wavelets.

26. The validation arrangement as claimed in claim 6, wherein the one or more coin sensors are inductive, and wherein the parameter is inductance.

27. The validation arrangement as claimed in claim 6, wherein the one or more coin sensors are capacitive, and wherein the parameter is capacitance.

* * * * *